United States Patent [19]

Reeves et al.

[11] Patent Number: 5,018,715

[45] Date of Patent: May 28, 1991

[54] FABRIC PICKUP DEVICE

[75] Inventors: Allen Reeves; Michael O. Harbor; Patrick V. Reina; Richard T. Sandgren, all of Nashville, Tenn.

[73] Assignee: Red Kap Industries, Nashville, Tenn.

[21] Appl. No.: 409,103

[22] Filed: Sep. 19, 1989

[51] Int. Cl.[5] ..... B65H 3/02

[52] U.S. Cl. ..... 271/19; 271/18.3

[58] Field of Search ..... 271/18.3, 19, 24, 25

[56] References Cited

U.S. PATENT DOCUMENTS

| | | | |
|---|---|---|---|
| 3,588,091 | 6/1971 | Stone et al. | 271/19 |
| 4,444,384 | 4/1984 | Keeton | 271/18.3 |
| 4,505,468 | 3/1985 | Heisler | 271/18.3 |
| 4,526,363 | 7/1985 | Fort | 271/268 |
| 4,579,331 | 4/1986 | Nestler | 271/18.3 |
| 4,697,837 | 10/1987 | Fort | 294/88 |

FOREIGN PATENT DOCUMENTS

| | | | |
|---|---|---|---|
| 2502325 | 7/1975 | Fed. Rep. of Germany | 271/18.3 |

*Primary Examiner*—Richard A. Schacher
*Attorney, Agent, or Firm*—Rhodes, Coats & Bennett

[57] ABSTRACT

A fabric pickup device useful for a fabric handling system. The fabric pickup device includes a fluid operated cylinder and piston having four individual fabric clutches attached to the cylinder and aligned with and substantially equality spaced apart from the axis of the piston. Each clutch has a head portion having a plurality, preferably four, resilient pickup fingers spaced apart from one another. A substantially flat actuator plate is attached to the free end of the piston and is oriented perpendicular to the axis of the piston. The actuator plate has a series of apertures for receiving the individual pickup fingers. The openings in the actuator plate are sized such that when the plate is retracted by the action of the fluid cylinder, the resilient fingers of each pickup finger separate and, when the plate is extended, the finger are brought together to grip the top surface of a fabric piece. Because the pickup fingers are actuated by the movement and contact with the actuator plate and are themselves fixedly mounted to the cylinder, the vertical position of the pickup fingers remains constant even during actuation, thereby reducing the degree of control necessary for reliable ply separation of small fabric pieces.

16 Claims, 2 Drawing Sheets

FABRIC PICKUP DEVICE

BACKGROUND OF THE INVENTION (1) Field of the Invention

The present invention relates generally to systems for handling fabric pieces for apparel manufacture and, in particular, to a new and novel pickup device for such a system.

(2) Description of the Prior Art

The move towards automation in the apparel industry has been hindered by the lack of a commercially viable means for removing pieces of fabric, one at a time, from a supported stack of fabric pieces. In order for the pickup device to be practical, it must have a high degree of reliability in separating a single piece of fabric from the top of a stack without picking up two or more pieces and, in addition, must be economical to manufacture and operate. For example, it has been estimated that one malfunction in one thousand operation cycles is the degree of reliability necessary for a profitable manufacturing operation.

One approach to this problem is illustrated in the Stone et al. patent (U.S. Pat. No. 3,558,091) which discloses an apparatus and method for picking up individual pieces of cloth from a stack, carrying the individual pieces of cloth away from the point of picking them up, and depositing them individually on a support, such as a conveyor. The entire disclosure of this patent is hereby incorporated in the file of the present case by reference and in its entirety. The pickup head, as taught by Stone, has a sleeve having one end secured to the piston of an air cylinder and the lower end formed to provide a plurality of equally spaced fingers having cloth-gripping or pinching bottom terminals. The sleeve is surrounded by a head or housing having a bore for receiving the sleeve which includes a lower adjustable portion which has a bore which engages the finger terminals when the air cylinder is actuated. Consequently, when the air cylinder is displaced downwardly, the surfaces of the gripping fingers contact the surface of the lower housing which results in closing the fingers so as to pinch a layer of cloth preparatory to lifting the cloth from the stack.

The Tex-Matic product brochure shows a fabric pickup having six individual gripping fingers equally spaced apart from one another. The fabric pickup device as disclosed by the Tex-Matic product brochure is air operated by a single cylinder which actuates the plurality of pickup fingers simultaneously. However, the product brochure does not describe the details of its operation or show a cutaway of the device.

In addition to the above "clutch-type" devices, various other pickup devices employing gripping jaws or wires or both have been proposed. U.S. Pat. Nos. 4,444,384; 4,526,363; and 4,697,837 are illustrative of such approaches.

Certain disadvantages become apparent with such designs. First, most of the prior art pickup devices are designed in such a way that a compound movement in both the vertical as well as the horizontal planes must be made in order to contact and pickup the fabric piece. This requires that the position of the device be carefully controlled in both the x, y directions and the z direction.

For example, in the construction of the pickup device as taught by Stone, the pickup fingers themselves actually move and, consequently, the distance between a fabric piece and the pickup head varies when the device is actuated. As a result, such a device cannot be readily adapted to a more simple and reliable x, y coordinate control system.

Second, many of the prior art devices require or at least prefer that the surface of the cloth be penetrated in part by a wire or needle in order to increase the reliability of the cloth pickup. Such penetration can result in undesirable surface defects, particularly in tightly woven or shear fabrics.

Finally, prior art devices to date have been overly complicated and expensive to construct to such a degree that they have not been widely adapted by the apparel manufacturing community. For example, the pickup devices as taught by Stone are each individually actuated by a corresponding individual air cylinder.

It has thus become desirable to develop a fabric pickup device for a fabric handling system that will reliably pickup pieces of fabric from a supported stack of fabric one at a time without picking up two or more pieces. It has also become desirable to develop a pickup device which will not mar the surface of the fabric. Finally, it has become desirable to develop a fabric pickup device which is simple and economical to manufacture and operate, thereby facilitating the move towards automation in the apparel industry.

SUMMARY OF THE INVENTION

The present invention solves the aforementioned problems associated with the prior art by providing an apparatus for picking up and placing fabric pieces. The fabric handling system includes a fabric pickup device, a slide frame for supporting the pickup device and moving the pickup device in a horizontal plane, and a magazine feed which moves the fabric pieces up to the pickup head and then retracts with the remaining fabric pieces after the pickup head has been actuated. In the preferred embodiment, the pickup device does not move with respect to the fabric pieces since it has been found that a substantially stationery vertical position of the pickup device is important in ply separation of small fabric pieces.

In the preferred embodiment, the fabric pickup device includes a fluid operated cylinder and piston having a plurality of individual fabric clutches attached to the cylinder and aligned with and substantially equality spaced apart from the axis of the piston. Each clutch has a head portion having a plurality, preferably four, resilient pickup fingers spaced apart from one another. A substantially flat actuator plate is attached to the free end of the piston and is oriented perpendicular to the axis of the piston. The actuator plate has a series of apertures for receiving the individual pickup fingers. The openings in the actuator plate are sized such that when the plate is retracted by the action of the fluid cylinder, the resilient fingers of each pickup finger separate and, when the plate is extended, the finger are brought together. Because the pickup fingers are actuated by the movement and contact with the actuator plate and are themselves fixedly mounted to the cylinder, the vertical position of the pickup fingers remains constant, even during actuation. In addition, the simplified design of the fabric pickup device of the present invention permits the economical, and therefore commercially viable, manufacture and use of the device.

Accordingly, one aspect of the present invention is to provide a pickup device for use with a fabric piece handling system. The device includes an actuating means adapted for movement between first and second positions; a plurality of clutches attached to the actuating means, each of the clutches having a head portion having a plurality of pickup fingers, the fingers being spaced apart from one another; and an actuator attached to the actuating means for simultaneously engaging the head portion of each of the plurality of clutches, thereby moving the plurality of pickup fingers between an open position and a closed position when the actuating means is moved from the first to the second position. Thus, the plurality of pickup fingers are operable to grip and hold the surface of a fabric piece when in the closed position and to release the surface of the fabric piece when in the open position.

Another aspect of the present invention is to provide a fabric handling system for supplying individual fabric pieces to a work station. The system includes: (a) support means for a stack of fabric pieces, the support means adapted to position the top piece of the stack at a predetermined position; (b) a fabric pickup device, the device including: (i) actuating means adapted for reciprocal movement between first and second positions; (ii) a plurality of clutches attached to the actuating means, each of the clutches having a head portion having a plurality of fabric pickup fingers; and (iii) an actuator attached to the actuation means for engaging each of the plurality of clutches and for moving the plurality of fabric pickup fingers between an open position and a closed position when the actuating means is moved from the first to the second position; and (c) transport means for receiving the pickup device and operable to move the device from a position adjacent the support means to a position adjacent the work station. Thus the plurality of fabric pickup fingers are operable to grip and hold the surface of fabric when in the closed position and adjacent to the support means and to release the surface of the fabric piece when in the open position adjacent the work station.

These and other aspects of the present invention will more clearly understood after a review of the following description of the preferred embodiment of the invention when considered with the drawings.

DESCRIPTION OF THE PREFERRED EMBODIMENTS

Figure 1:
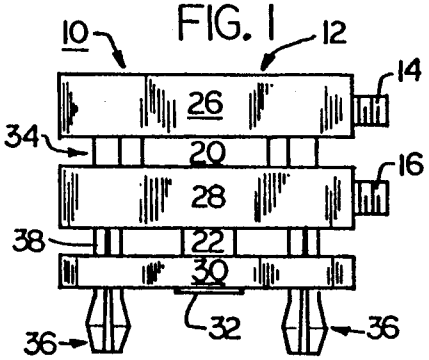
FIG. 1 is a front elevational view of a fabric pickup device, constructed in accordance with the present invention in its open position.

Referring now to the drawings in general and to FIG. 1 in particular, it will be understood that the illustrations are for the purpose of describing a preferred embodiment of the invention and are not intended to limit the invention thereto. As best seen in FIG. 1, a fabric pickup device, generally designated 10, constructed in accordance with the present invention, is shown in its open position. In the preferred embodiment, fabric pickup device 10 includes a double acting pneumatic cylinder 12 having first and second inputs 14, 16 connected to a selectively actuated air supply (not shown). Pneumatic cylinder 12 includes a central cylinder portion 20 which surrounds a central plunger and shaft assembly 22. A top end cap 26 and bottom end cap 28 are attached to each end of central cylinder 20 to complete the assembly. Any of a number of conventional pneumatic cylinders could be adapted to the present invention, however, one such cylinder which is particularly suitable is a BIMBA flat cylinder available from Sloane Fluid, 10033 Elm Hill Pike, Nashville, Tennessee.

A circular actuator plate 30 is connected to the free end of shaft 22 by means of fastener 32. A plurality of fabric clutches 34 extend through apertures 44, 46 in actuator plate 30 and bottom end cap 28, respectively, and are fastened to top end cap 26. Each clutch 34 includes a clutch head portion 36 having a plurality of fabric pickup fingers 37 and a clutch shaft portion 38. One clutch which has been found particularly suitable is a KOH-1-NOOR pencil lead clutch available from Ardias S.A., 20021 Baranzate, Milan, Italy.

Figure 2:
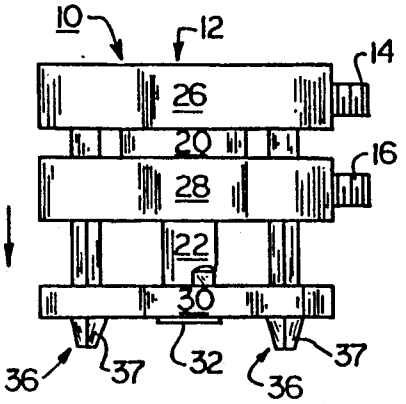
FIG. 2 is an identical front elevational view of the pickup device shown in FIG. 1 but in its closed position.

As best seen in FIG. 2, when central plunger shaft assembly 22 is extended, actuator plate 30 contacts the outer surface of clutch heads 36, thereby moving the plurality of pickup fingers 37 between an open position and a closed position.

Figure 3:
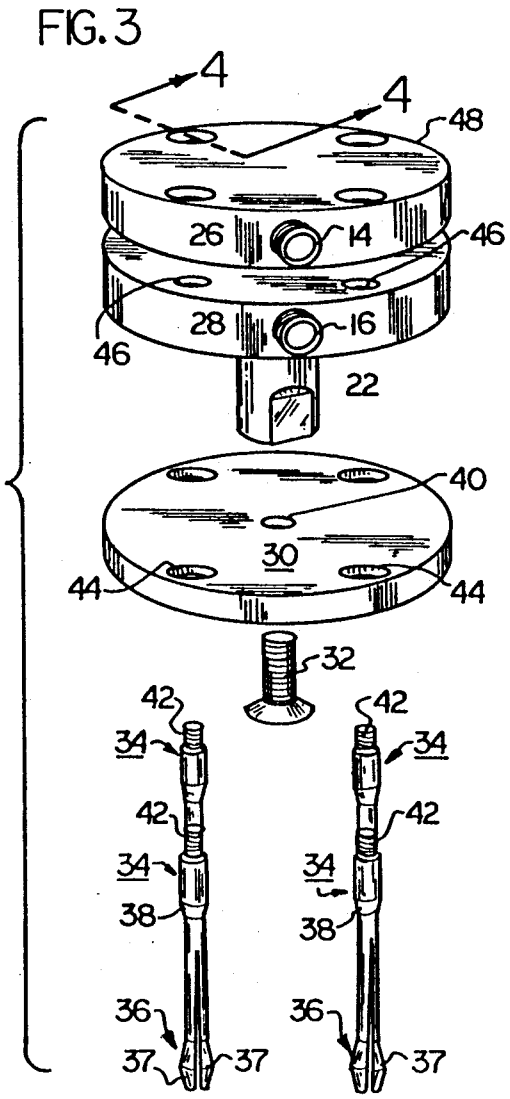
FIG. 3 is an exploded perspective view of the pickup device shown in FIGS. 1 and 2.

The construction of fabric pickup device 10 can best be understood by referring to FIG. 3 which shows an exploded perspective view of device 10. As can be seen, plate 30 includes a centrally located aperture 40 for permitting fastener 32 to pass through and be attached to shaft assembly 22. Each clutch 34 has a threaded portion 42, a shaft portion 38, and a head portion 36. Actuator plate 30 includes a plurality of apertures 44 corresponding to each clutch 34 which permits the threaded portion 42 and shaft portion 38 of each clutch 34 to extend therethrough. In addition, cylinder cap 28 includes a plurality of similarly sized apertures 46 for permitting passage of clutch shafts 38 and threaded clutch shaft 42. Finally, top cylinder cap 26 includes a plurality of threaded apertures 48 for securing threaded shaft 42 of clutch 34.

Figure 4:
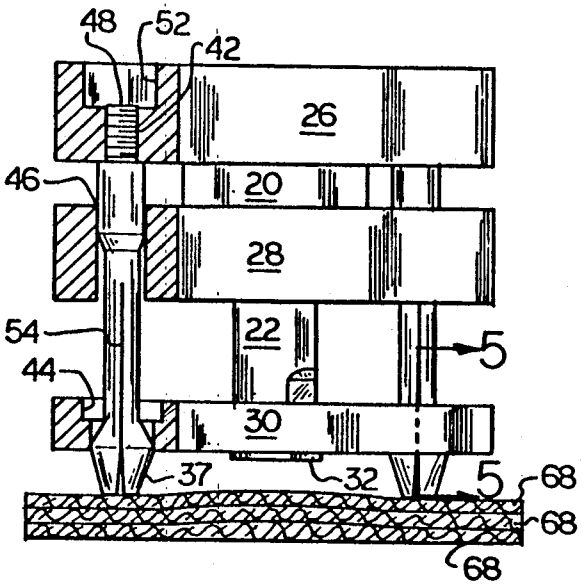
FIG. 4 is an enlarged fragmentary vertical section through the pickup device shown in FIG. 2, taken along line 4—4, illustrating the action of the fabric pickup fingers.

Turning now to FIG. 4, in the preferred embodiment, the end of threaded shaft 42 opposite clutch head 36 is adapted to receive a hex wrench and threaded aperture 48 extends completely through the top cylinder cap 26, thereby permitting clutches 34 to be installed or removed without contacting the more delicate clutch head portion 36. Also apertures 48 may include an enlarged unthreaded portion 52 which permits easier access to threaded shaft 42.

Figure 5:
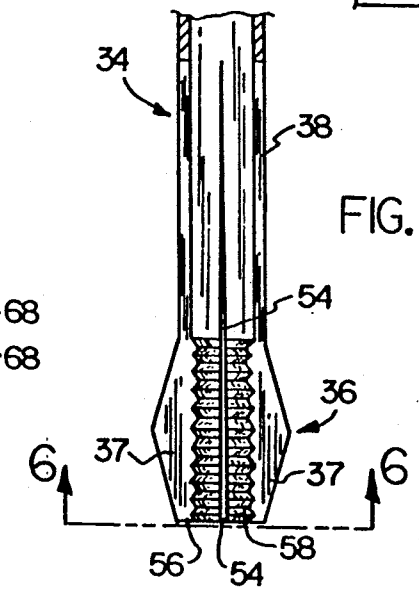
FIG. 5 is an enlarged fragmentary vertical section through one clutch of the pickup device shown in FIG. 4, taken along line 5—5, illustrating the geometry of the fabric pickup fingers.
Figure 6:
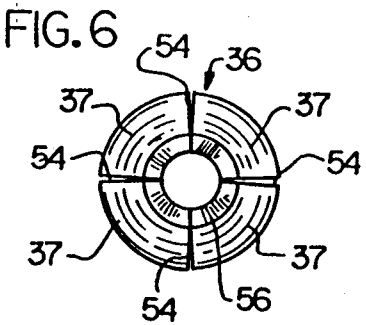
FIG. 6 is an enlarged bottom view of one clutch of the pickup device shown in FIG. 4, taken along line 6—6, further illustrating the geometry of the fabric pickup fingers.

As best seen in FIGS. 5 and 6, in the preferred embodiment, clutch head 36 is divided into four, substantially equal, quadrants by means of a pair of intersecting slits 54 having a length of approximately 0.75 inches and a width of approximately 0.005 inches. Also, in the preferred embodiment, each fabric pickup finger 37 is formed into a point-like tip 56 having a significantly smaller cross-sectional area than clutch head portion 36. Testing has indicated that the pointed fingers 56 are significantly more effective in picking up a fabric piece than blunted fingers having a higher cross-section area. In addition, clutch shaft 38 and head portion 36 has an annular cross section with the inner diameter being approximately 0.125 inches and having a series of parallel grooves 58 extending along a portion of their length. It is believed that this open and roughened inner surface of clutch head 36 contributes to the reliability of device 10.

Figure 7:
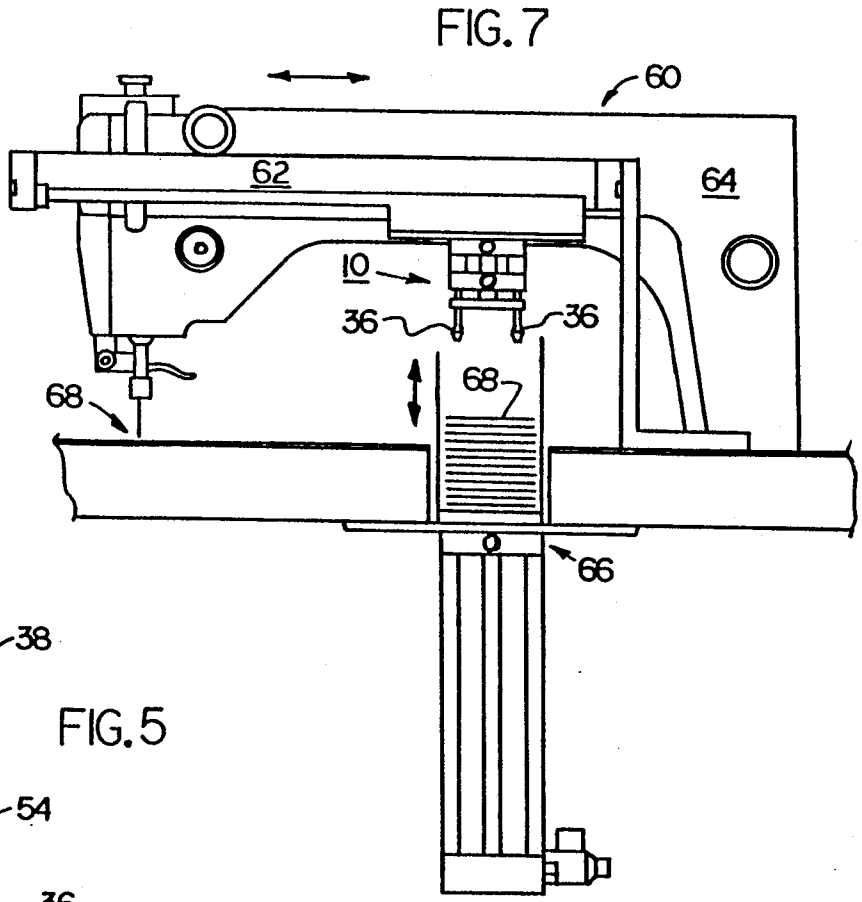
FIG. 7 is a side elevational view of a fabric handling system incorporating the fabric pickup device shown in the preceding figures.

Finally, turning to FIG. 7, there is shown a side elevational view of a fabric handling system, generally designated 60, incorporating the fabric pickup device 10 shown in the preceding figures. In this example, fabric pickup device 10 is mounted to a pneumatic or electrically actuated slide 62. Slide 62 is mounted adjacent to a conventional commercial sewing machine 64 and is adapted to move the pickup device 10 from a fabric piece loading position to a fabric piece unloading position. A magazine assembly 66 is mounted adjacent to the loading position of slide 62 and is operable to move a stack of fabric sheets 68 into contact with clutch heads 36 where the plurality of fabric pickup fingers 37 are operable to grip and hold the surface of the top fabric piece when in its closed position and adjacent to the magazine assembly 66 and to release the fabric piece when in its open position adjacent to the work station of machine 64.

In operation, the fabric pickup device 10 is moved along slide 62 until it is adjacent to magazine assembly 66. Magazine assembly 66 moves the stack 48 of fabric pieces up into contact with the pickup head 36. Next, cylinder 12 is actuated and piston 22 and actuator plate 30 are extended, contacting the outer surface of clutch heads 36 and bring resilient fingers 37 together to grip and hold the surface of the top fabric piece. Magazine 66 then retracts with the remaining fabric pieces. The head portion 36 of pickup device 10 does not move vertically with respect to the fabric pieces 48, thereby reducing the degree of control necessary for ply separation of small fabric pieces. Slide 62 is then actuated to move pickup device 10 along a horizontal path to work station 68 of machine 64. Cylinder 12 is again actuated and piston 22 and actuator plate 30 are retracted, allowing the resilient pickup fingers 37 of clutch heads 36 to open and release the surface of the fabric piece. This operation is continuously repeated.

Certain modifications and improvements will occur to those skilled in the art upon reading of the foregoing description. By way of example, additional clutches could be added to the pickup device to further increase its reliability. In addition, while a pneumatic cylinder is the preferred embodiment, other linear actuators may be adapted to perform the same function. It should be understood that all such modifications and improvements have been deleted herein for the sake of conciseness and readability but are properly within the scope of the following claims.

I claim:

1. A pickup device for use with a fabric piece handling system, said device comprising:

(a) actuating means having a portion adapted for movement between first and second positions;

(b) a plurality of clutches attached to said actuating means, each of said clutches having a head portion having a plurality of pickup fingers, said fingers being spaced apart from one another;

(c) an actuator attached to said portion of said actuating means for simultaneously engaging said head portion of each of said plurality of clutches, thereby moving said plurality of pickup fingers between an open position and a closed position when said portion of said actuating means is moved from said first to said second position; and (d) a locating means for locating the actuating means and fabric to be picked up such that said clutches are in contact with a piece of fabric to be picked up, whereby said actuating means may be located with said clutches in contact with a piece of fabric to be handled, at which time said actuator is operable so said plurality of pickup fingers are moved to said closed position to grip and hold the surface of a fabric piece.

2. The apparatus according to claim 1, wherein said actuating mans includes a fluid operated piston mounted for reciprocal movement with respect to said plurality of clutches and having the free end of said piston attached to said actuator.

3. The apparatus according to claim 2, wherein said actuator is a substantially flat plate oriented perpendicular to the axis of said piston and having a plurality of apertures corresponding to each of said clutches.

4. The apparatus according to claim 3, wherein the diameter of each of said plurality of apertures is less than the diameter of said head portion of each of said clutches, thereby engaging said head portion of each of aid plurality of clutches and moving said plurality of pickup fingers from said open position to said closed position when said actuating means is moved from said first to said second position.

5. The apparatus according to claim 2, wherein said plurality of clutches attached to said actuating means are aligned with the axis of said piston.

6. The apparatus according to claim 5, wherein said plurality of clutches attached to said actuating means are substantially equally spaced apart from the axis of said piston.

7. The apparatus according to claim 1, wherein said actuator is a substantially flat plate having a plurality of apertures corresponding to each of said clutches.

8. The apparatus according to claim 3, wherein the diameter of each of said plurality of apertures is less than the diameter of aid head portion of each of said clutches, thereby engaging said head portion of each of said plurality of clutches and moving said plurality of pickup fingers from said open position to said closed position when said actuating means is moved from said first to said second position.

9. The apparatus according to claim 1, wherein said plurality of clutches attached to said actuating means each have at least two pair of said pickup fingers.

10. The apparatus according to claim 9, wherein said plurality of clutches attached to said actuating means each have at least two longitudinal slits extending upwardly away from said head portion of each of said clutches, said slits being oriented perpendicular to one another, whereby said slits divide said head portion of said clutches into approximately equal quadrants to form said pair of said pickup fingers.

11. The apparatus according to claim 1, wherein said pickup device includes at least two of said clutches attached to said actuating means.

12. The apparatus according to claim 11, wherein said pickup device preferably includes between three and six of said clutches attached to said actuating means.

13. The apparatus according to claim 1, wherein said plurality of clutches attached to said actuating means each have a tubular space extending upwardly away from said head portion of each of said clutches, said tubular space being concentrically oriented with the longitudinal axis of said clutches, whereby said tubular space is operable to improve the grip and hold on the surface of a fabric piece.

14. The apparatus according to claim 13, wherein said the interior surfaces of said plurality of clutches attached to said actuating means each have a plurality of concentric grooves, whereby said grooves are operable to improve the grip and hold on the surface of a fabric piece.

15. The apparatus according to claim 1, wherein said head portion of each of said plurality of clutches attached to said actuating means include an exterior circumferential conically tapered camming face, wherein when said face is engaged by said actuator attached to said actuating means, said plurality of pickup fingers are moved between an open position and a closed position when said actuating means is moved from said first to said second position.

16. A fabric handling system for supplying individual fabric pieces to a work station, said system comprising:

(a) support means for a stack of fabric pieces, said support means adapted to position the top piece of the stack at a predetermined position;

(b) a fabric pickup device, said device including:

(i) actuating means having a portion adapted for reciprocal movement between first and second positions;

(ii) a plurality of clutches attached to said actuating means, each of said clutches having a head portion having a plurality of fabric pickup fingers; and (iii) an actuator attached to said portion of said actuating means for engaging each of said plurality of clutches and for moving said plurality of fabric pickup fingers between an open position and a closed position when said portion of said actuating means is moved from said first to said second position; and (c) transport means for moving said pickup device from a position at which said clutches are in contact with a top piece of fabric at said predetermined position to a position adjacent said work station, whereby said portion of said actuating means may be moved to a second position to close said plurality of fabric pickup fingers to grip and hold the surface of a piece of fabric at said predetermined position and to release the surface of the fabric piece when in said open position adjacent said work station.

* * * * *